US006622672B1

(12) United States Patent
Styron et al.

(10) Patent No.: US 6,622,672 B1
(45) Date of Patent: Sep. 23, 2003

(54) VARIABLE COMPRESSION RATIO CONTROL SYSTEM FOR AN INTERNAL COMBUSTION ENGINE

(75) Inventors: Joshua Putman Styron, Canton, MI (US); Richard Parry-Jones, Essex (GB)

(73) Assignee: Ford Global Technologies, L.L.C., Dearborn, MI (US)

( * ) Notice: Subject to any disclaimer, the term of this patent is extended or adjusted under 35 U.S.C. 154(b) by 0 days.

(21) Appl. No.: 10/064,801

(22) Filed: Aug. 19, 2002

(51) Int. Cl.[7] ..... F02B 75/02
(52) U.S. Cl. ..... 123/78
(58) Field of Search ..... 123/78

(56) References Cited

U.S. PATENT DOCUMENTS

| | | | | |
|---|---|---|---|---|
| 2,420,117 A | | 5/1947 | Weatherup | |
| 2,779,291 A | | 1/1957 | Albright | |
| 3,496,879 A | | 2/1970 | Brandes | |
| 3,642,086 A | | 2/1972 | Andrews | |
| 3,788,075 A | | 1/1974 | Holdeman et al. | |
| 3,828,555 A | | 8/1974 | Capdevielle | |
| 4,022,269 A | | 5/1977 | Segawa | |
| 4,202,174 A | | 5/1980 | Grigorenko et al. | |
| 4,414,809 A | | 11/1983 | Burris | |
| 4,516,537 A | * | 5/1985 | Nakahara et al. | 123/48 AA |
| 4,561,248 A | | 12/1985 | Quin et al. | |
| 4,616,727 A | | 10/1986 | Kircher et al. | |
| 4,741,673 A | | 5/1988 | Jubb | |
| 4,754,603 A | | 7/1988 | Rosman | |
| 4,798,050 A | | 1/1989 | Nakamura et al. | |
| 5,136,987 A | * | 8/1992 | Schechter et al. | 123/48 B |
| 5,209,317 A | | 5/1993 | Schnelle | |
| 5,247,911 A | * | 9/1993 | Nenicka | 123/48 B |
| 5,265,421 A | | 11/1993 | Somers | |
| 5,331,928 A | * | 7/1994 | Wood | 123/78 B |
| 5,669,461 A | | 9/1997 | Buschur | |
| 6,192,680 B1 | | 2/2001 | Brugman et al. | |
| 6,397,796 B1 | * | 6/2002 | Styron et al. | 123/78 AA |

* cited by examiner

*Primary Examiner*—Willis R. Wolfe
*Assistant Examiner*—Douglas A. Salser
(74) *Attorney, Agent, or Firm*—John F. Buckert; Allan J. Lippa

(57) ABSTRACT

A variable compression ratio control system for an internal combustion engine includes an engine driven accessory hydraulic pump and a hydraulic accumulator system for receiving hydraulic fluid from the engine driven accessory pump. The hydraulic accumulator also receives engine oil from an engine oil pump. A variable compression ratio actuator is supplied with high pressure engine lubricating oil from the hydraulic accumulator system so as to control the compression ratio of the engine.

24 Claims, 4 Drawing Sheets

VARIABLE COMPRESSION RATIO CONTROL SYSTEM FOR AN INTERNAL COMBUSTION ENGINE

BACKGROUND OF INVENTION

1. Field of the Invention

The present invention relates to a system for providing high pressure engine lubricating oil to a variable compression ratio actuator used for the purpose of changing the compression ratio of a reciprocating internal combustion engine.

2. Disclosure Information

Many types of variable compression ratio control systems have been either used in serial production, or at least proposed by designers of automotive reciprocating internal combustion engines. Typically, engines with compression ratio control are operated at lower compression ratio at higher loads and at higher compression ratios at lower and medium loads. In this manner, engine fuel consumption may be minimized. With many types of variable compression ratio ("VCR") systems, it is necessary to provide an external control signal to the VCR mechanism. This presents a dilemma to the engine designer inasmuch as high pressure engine lubricating oil may be provided with an engine driven oil pump, but this is wasteful of energy because under most conditions the higher pressure oil will need to be bypassed or otherwise pressure relieved, and this causes unwanted consumption of energy as well as heating of the oil and possibly foaming when the oil is discharged through a high pressure relief valve system. If, on the other hand, a high pressure source such as an externally mounted hydraulic pump is used for powering a VCR actuator, additional problems arise. More specifically, hydraulic accessories are typically designed to use hydraulic oil as a working fluid. Thus if leakage from the VCR actuator into the interior of the engine occurs, the engine's lubricating oil would quickly become contaminated with hydraulic fluid. As a result, the need to use hydraulic oil would limit the capability or applicability of VCR actuator control systems.

A system and method according to the present invention solves problems associated with known systems such as that shown in U.S. Pat. No. 2,420,117, in which a single working fluid is used for both the pressurized working fluid and for the fluid being supplied to a VCR actuator. The present system allows high pressure hydraulic fluid to be used as a muscle for providing a supply of high pressure engine lubricating oil to a VCR actuator. The present inventive system allows maximum energy savings because the engine oil pump will be required to furnish only lower pressure oil in the range usually ascribed to such pumps (e.g. pressure less than a 100 PSI), Further, the engine driven accessory hydraulic pump need only have a slight increase in capacity, if any, needed to drive the VCR control system, because the demands imposed by the VCR control system are generally minimal, if nonexistent, at low vehicle speeds such as those encountered in parking lot maneuvering, when the demand upon the accessory hydraulic fluid supply is greatest. And, this is true regardless whether the hydraulic accessory is a power steering gear or an engine radiator cooling fan, because these and other hydraulically powered accessories place the greatest demand on the engine driven accessory hydraulic pump at idle and off-idle operation.

SUMMARY OF INVENTION

A variable compression ratio control system for an internal combustion engine includes an engine driven accessory hydraulic pump and a hydraulic accumulator system for receiving high pressure hydraulic fluid from the engine driven accessory pump and lower pressure engine oil from an engine oil pump. A variable compression ratio actuator receives high pressure engine lubricating oil from a variable compression ratio supply circuit, which in turn receives high pressure lubricating oil from the hydraulic accumulator system. According to the present invention, the engine driven accessory hydraulic pump may comprise either a power steering pump, or an engine cooling fan pump or other type of pump driven by the engine and providing high pressure hydraulic fluid to various engine accessories. Such pumps may be driven by either a belt, or a chain, or gears, or other drives, as is conventional. The pump may comprise a piston pump, a gear pump, a gerotor pump, or other types of pumps known to those skilled in the art and suggested by this disclosure.

According to another aspect of the present invention, a hydraulic accumulator system for use in a variable compression ratio control system may include a first chamber for receiving hydraulic fluid from an engine driven accessory hydraulic pump, and a second chamber for receiving engine lubricating oil from an engine lubricating oil circuit and for providing highly pressurized lubricating oil to a variable compression ratio supply circuit. Finally, a third chamber is interposed between the first and second chambers and comprises an elastically compressible medium for maintaining pressure within the second chamber as lubricating oil is withdrawn from the second chamber.

According to another aspect of the present invention, a variable compression ratio control system may include as a VCR actuator including a variable length connecting rod such as that disclosed in U.S. patent application Ser. No. 09/682,682 entitled "Variable Compression Ratio Connecting Rod" filed on Oct. 5, 2001, which is assigned to the assignee of the present invention and which is hereby incorporated by reference within this specification. Alternatively, a VCR actuator used in a system according to present invention may comprise other types of devices known to those skilled in the art and suggested by this disclosure. What is important here is that the VCR actuator requires a source of high pressure engine lubricating oil furnished by the present system.

According to another aspect of the present invention, a hydraulic accumulator system may include a first gas-charged accumulator having a liquid chamber for receiving hydraulic fluid from an engine driven accessory pump, and a gas chamber communicating with the gas chamber of a second gas-charged accumulator, with the second accumulator having a liquid chamber communicating with the variable compression ratio supply circuit. In this manner, the liquid chamber of the second accumulator supplies high pressure engine lubricating oil to the VCR supply circuit. Alternatively, the hydraulic accumulator system may include a primary accumulator having a first liquid chamber for receiving hydraulic fluid from the engine driven accessory pump and a second liquid chamber communicating with a liquid chamber of a second gas-charged accumulator, as well as with a variable compression ratio supply circuit. In this case, the second liquid chamber of the primary accumulator and the liquid chamber of the secondary gas-charged accumulator will be charged with high pressure engine lubricating oil. With this latter system, the swept volume of the primary and secondary accumulators may be equivalent; alternatively the swept volume of the primary accumulator may be less than the swept volume of the secondary accumulator.

According to another aspect of the present invention, a hydraulic accumulator system according to the present invention may comprise a hydraulic motor driven by hydraulic fluid from an engine driven accessory pump and a control pump coupled to and driven by the hydraulic motor, with the control pump being in fluid communication with and receiving oil flowing from a lubricating oil pump driven by the engine. According to this embodiment a system further includes a gas-charged accumulator having a liquid chamber for receiving pressurized lubricating oil from the control pump, with the liquid chamber of the accumulator being in fluid communication with a variable compression ratio supply circuit. As an alternative, the hydraulic accumulator system may include a hydraulic motor driven by hydraulic fluid from the engine driven accessory pump and a control pump coupled to and driven by the hydraulic motor with the control pump being in fluid communication with oil flowing from a lubricating oil pump driven by the engine. The system further includes a gas-charged accumulator having a liquid chamber for receiving pressurized lubricating oil from the control pump, with the liquid chamber of the accumulator being in fluid communication with the VCR supply circuit and with the power steering system.

According to another aspect of the present invention, a VCR control system for an internal combustion engine includes an engine driven lubricating oil pump and an engine driven accessory hydraulic pump. A hydraulic motor driven by hydraulic fluid from the engine driven accessory pump is coupled to and drive a control pump. The control pump is in fluid communication with oil flowing from the lubricating oil pump. A gas-charged accumulator has a liquid chamber for receiving pressurized lubricating oil from the control pump, with a variable compression ratio supply circuit being in fluid communication with the liquid chamber of the accumulator and with the VCR supply circuit furnishing a high pressure lubricating oil control signal to the variable compression ratio actuator.

According to another aspect of the present invention, a hydraulic motor as described herein may comprise either gear motor or piston motor or another type of motor which converts energy transferred by high pressure hydraulic fluid to circular motion.

According to another aspect of the present invention, a method for powering a variable compression ratio control system of an internal combustion engine includes the steps of providing a source of high pressure hydraulic fluid from an engine driven hydraulic pump, and providing a control pump driven by the high pressure hydraulic fluid. Further, included are the steps of charging a hydraulic accumulator with engine lubricating oil pressurized by the control pump, and feeding high pressure engine lubricating oil to the variable compression ratio actuator. The present method may further comprise a step of providing high pressure hydraulic fluid from the engine driven hydraulic pump to a power steering gear, to a power brake system or to an engine cooling fan or other type of hydraulically powered device.

It is an advantage of the present invention that a system and method according to this invention will provide a variable compression ratio control signal in a form of engine lubricating oil, without causing unnecessary energy consumption arising from avoidable pumping losses.

It is another advantage of the present invention that a system and method according to this invention requires minimum packaging in terms of minimum volume for the underhood portion of the system.

It is another advantage of the present invention that this system and method allow use of VCR actuators driven by engine oil, as opposed to hydraulic fluid. In this method, contamination of the engine lubricating oil by hydraulic fluid is avoided.

It is another advantage of the present invention that this system and method may be used to supply a high pressure lubricating oil control signal to a VCR mechanism which is deep within an engine, such that the lubricating oil will combine with the other lube oil in the engine without the possibility of oil contamination.

Other advantages, as well as features and objects of the present invention will become apparent to the reader of this specification.

DETAILED DESCRIPTION

Figure 1:
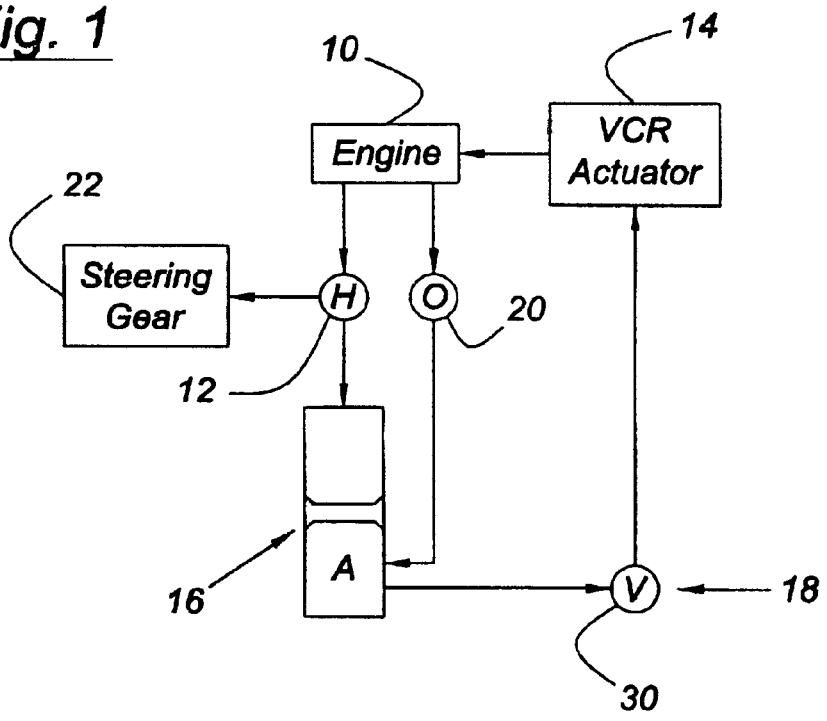
FIG. 1 is a schematic representation of an automotive internal combustion engine having a variable compression ratio control system according to the present invention.

As shown in FIG. 1, internal combustion engine 10 drives accessory hydraulic pump 12. Pump 12 provides high pressure hydraulic fluid to steering gear 22, and to hydraulic accumulator system 16. Engine lubricating oil furnished by engine oil pump 20 is also transmitted to hydraulic accumulator system 16. The engine lubricating oil is highly pressurized within hydraulic accumulator 16 and is discharged through a VCR supply circuit including VCR supply valve 30 and associated piping to VCR actuator 14. Those skilled in the art will appreciate in view of this disclosure that valve 30 would normally be controlled by a powertrain control module or an engine control module, or for that matter, a free standing VCR control module. In any case, the purpose of a system and method according to the present invention is to provide engine lubricating oil at proper pressure to VCR actuator 14, and this may be accomplished by controlling the flow through valve 30 using pulsewidth modulation or other types of control schemes and valves known to those skilled in the art and suggested by this disclosure. This invention is related to the furnishing of the high pressure lubricating oil for the VCR control system.

Figure 2:
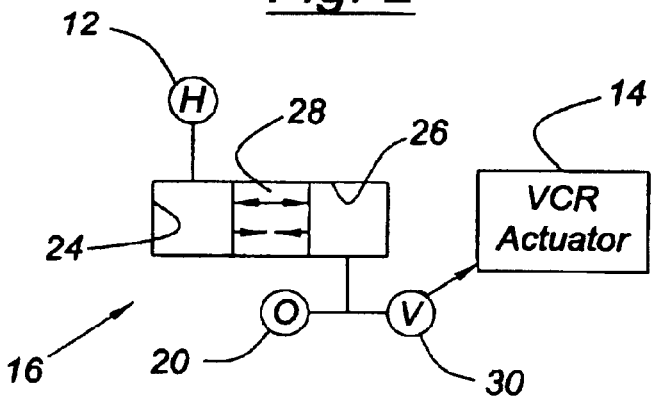
FIG. 2 is a schematic representation of a first type of hydraulic accumulator system employed with a system and method according to the present invention.

FIG. 2 illustrates a second type of hydraulic accumulator system according to the present invention. As before, engine driven accessory hydraulic pump 12 provides high pressure hydraulic fluid to a first chamber, 24. A second chamber, 26, contains engine lubricating oil which- is sent to chamber 26 by means of oil pump 20. High pressure oil leaving second chamber 26 is discharged through VCR supply valve 30 to VCR actuator 14. Third chamber 28, which is interposed between first chamber 24 and second chamber 26, includes an elastically compressible medium. This may comprise either a compressed gas, in which case the bulkheads of third chamber 28 will comprise individual pistons; alternatively, third chamber 28 could comprise a compressible elastomer which undergoes volume changes in response to pressure imposed by the lubricating oil and hydraulic upon the body of elastomer.

Figure 3:
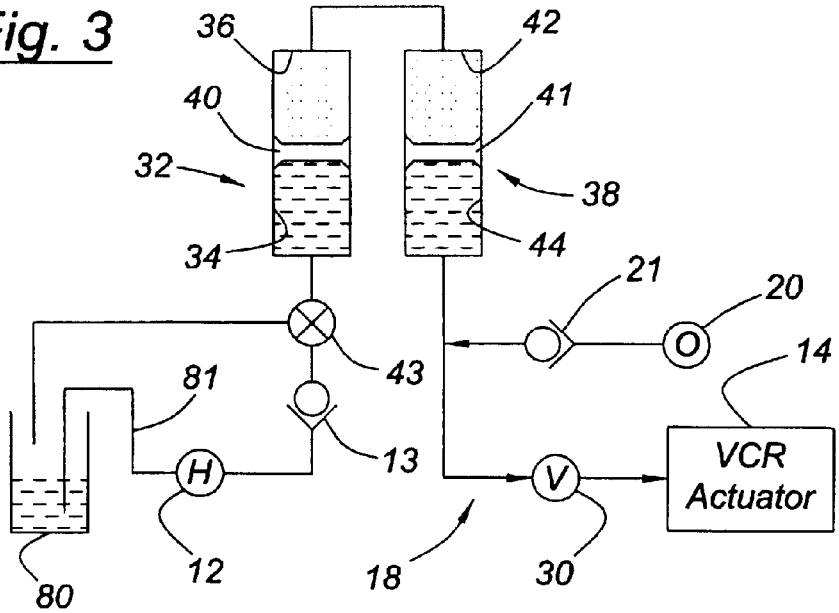
FIG. 3 illustrates a gas-coupled VCR control system according to the present invention.

FIG. 3 illustrates another type of variable compression ratio control system in which gas coupling is used. As before, high pressure hydraulic fluid is provided by engine driven accessory hydraulic pump 12. The hydraulic fluid discharged by pump 12 passes through check valve 13 which prevents backflow of hydraulic fluid into pump 12 when the pressure output of pump 12 is less than the pressure within the fluid line downstream of pump 12. High pressure hydraulic fluid from pump 12 is conducted to liquid chamber 34 which is part of a first accumulator, 32, which is a gas-charged accumulator. As hydraulic fluid under high pressure enters chamber 34, piston 40 of first accumulator 32 is caused to move in the direction so as to compress gas contained within gas chamber 36 of first accumulator 32. In turn, the high pressure compressed gas within chamber 36 is transmitted to gas chamber 42 of second accumulator 38. The high pressure gas within chamber 42 causes piston 38 to apply compressive force to engine oil contained within liquid chamber 44 of second gas-charged accumulator 38. The engine lubricating oil within liquid chamber 44 arises from engine driven oil pump 20 and first flows through check valve 21 which prevents backflow of oil from chamber 44 through oil pump 20 when the output of oil pump 20 is less than the chamber pressure in chamber 44. Engine oil is discharged to VCR actuator 14 via VCR supply circuit 18, including VCR supply valve 30. In order to recharge the system, it is necessary to evacuate hydraulic fluid from liquid chamber 34 of first accumulator 32. This is accomplished by setting recharge valve 43, so as to allow hydraulic fluid to be transmitted to reservoir 80, thereby becoming available to engine driven accessory hydraulic pump 12 through line 81.

Figure 4:
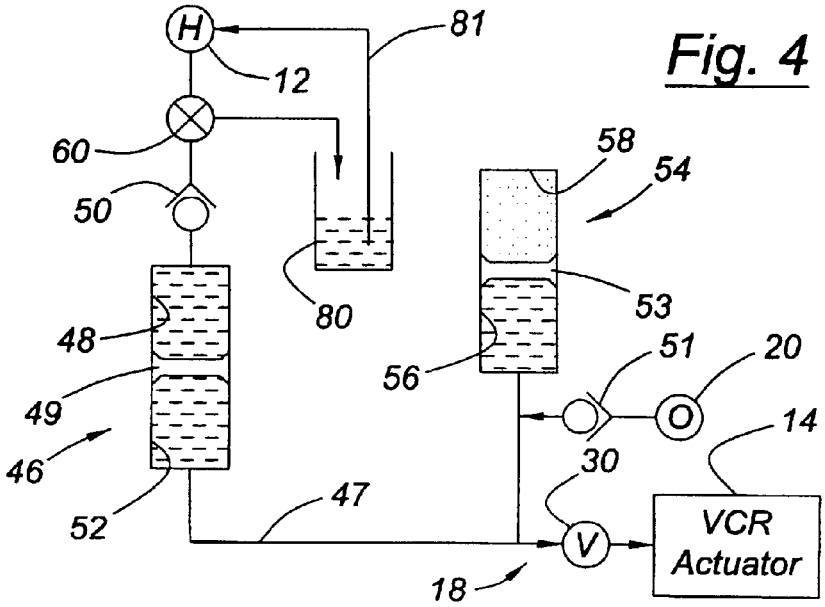
FIG. 4 illustrates a fluid-coupled VCR control system according to the present invention.

FIG. 4 illustrates a fluid coupled VCR control system in which engine driven accessory hydraulic pump 12 furnishes high pressure hydraulic fluid to first liquid chamber 48 of primary accumulator 46. The hydraulic fluid within chamber 48 forces piston 49 to place compressive force upon engine oil contained within liquid chamber 52 of primary accumulator 46. This pressurized oil also moves through line 47 and into liquid chamber 56 of secondary accumulator 54. The engine lubricating oil within liquid chamber 56 forces piston 53 to apply compressive force to a gas, such as nitrogen, contained within chamber 58 of secondary accumulator 54. Engine lubricating oil originates as before from engine driven oil pump 20 and flows through check valve 51 into liquid chamber 56 of accumulator 54. Engine oil is discharged from chamber 56 and from chamber 52. As before, a recharge valve, 60, allows hydraulic fluid to be removed from first liquid chamber 48 and transferred to reservoir 80 in order to recharge the present system with engine lubricating oil.

Figure 5:
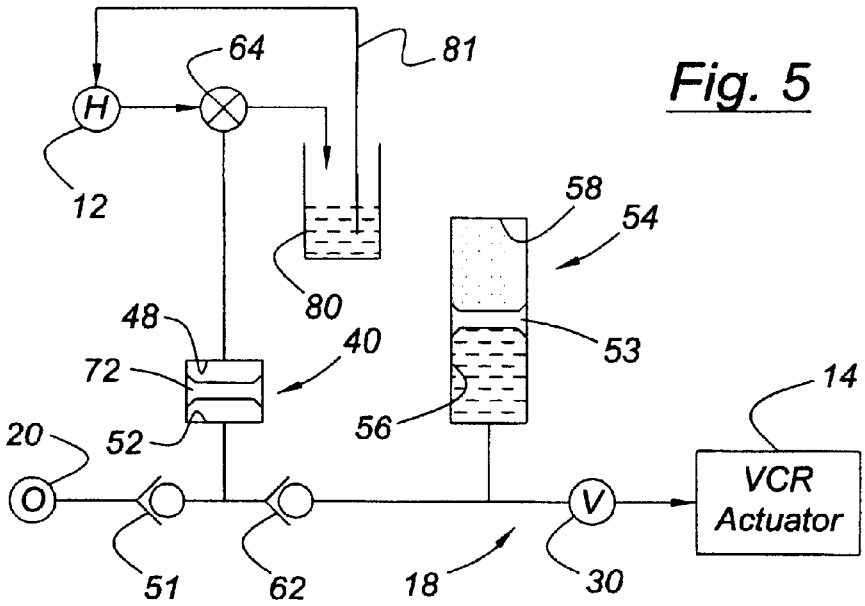
FIG. 5 illustrates a hydraulically driven oil pump VCR control system constructed according to the present invention.

FIG. 5 illustrates a system according to present invention in which accessory hydraulic pump 12 picks up hydraulic fluid from reservoir 80 and conducts fluid through line 81 to pump 12, with the hydraulic fluid being discharged though three-port recharge valve 64. Recharge valve 64 of FIG. 5 not only allows oil to return from first liquid chamber 48 of piston pump 70 to reservoir 80, but also allows oil to be admitted into first liquid chamber 48 of piston pump 70. In this manner, piston 72 of piston pump 70 will be allowed to reciprocate, so as to subject engine lubricating oil within second liquid chamber 52 of piston pump 70 to pressurization in a pulsating fashion. During the recharging process, oil at a lower pressure from engine driven oil pump 20 passes through check valves 51 and 62 and then into liquid chamber 56 of secondary accumulator 54, as piston 72 forces hydraulic fluid out of chamber 48. As before, piston 53 places compressive force upon gas such as nitrogen, contained within gas chamber 58 of secondary accumulator 54. Engine lubricating oil is then discharged through VCR supply circuit 18, including VCR supply valve 30, and the high pressure engine lubricating oil is provided to VCR actuator 14.

Figure 6:
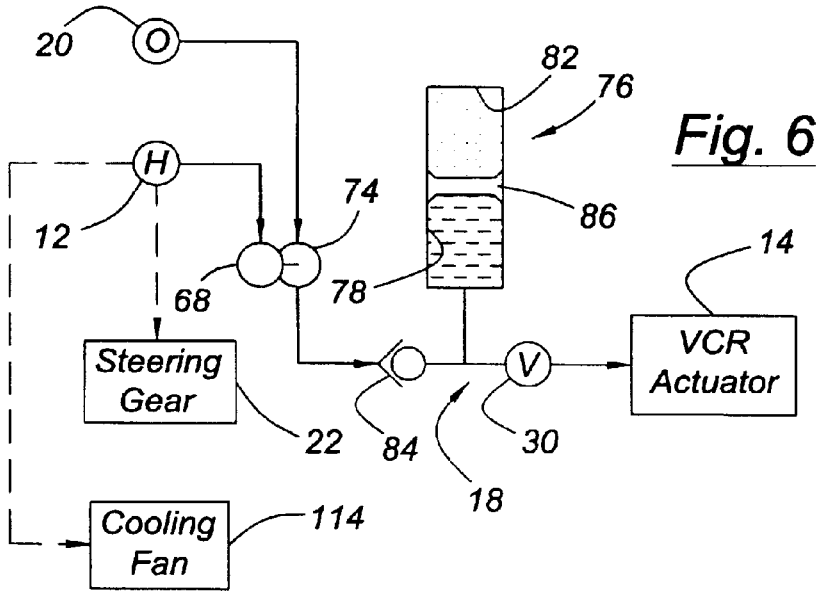
FIG. 6 illustrates a parallel hydraulically powered pump VCR control system according to the present invention.

FIG. 6 illustrates an embodiment according to the present invention in which high pressure hydraulic fluid originating from pump 12 powers hydraulic motor 68, which is close-coupled to control pump 74. Note that engine driven accessory hydraulic pump 12 also furnishes high pressure hydraulic fluid to steering gear 22 and also to cooling fan motor 114. Those skilled in the art will appreciate in view of this disclosure, however, that a method and system according to the embodiment of FIG. 6 could be employed without the need for furnishing hydraulic fluid to steering gear 22 and cooling fan 114.

Continuing with FIG. 6, high pressure engine lubricating oil flowing from control pump 74 passes through check valve 84 and then into liquid chamber 78 of accumulator 76. The high pressure lubricating oil within liquid chamber 78 causes piston 86 to apply compressive force to gas contained within gas chamber 82 of accumulator 76. As before, engine lubricating oil discharged through VCR supply circuit 18, including VCR supply valve 30, is supplied to VCR actuator 14. The system of FIG. 6 is very package efficient. In other words, the system will occupy a relatively smaller volume under the hood of a vehicle, as compared with other VCR control systems. Part of this advantage arises because the system requires but a single accumulator. The system of FIG. 6 is a parallel system in which high pressure hydraulic fluid is provided at substantially the same pressure to not only hydraulic motor 68, but also to steering gear 22 as well as the cooling fan 114.

Figure 7:
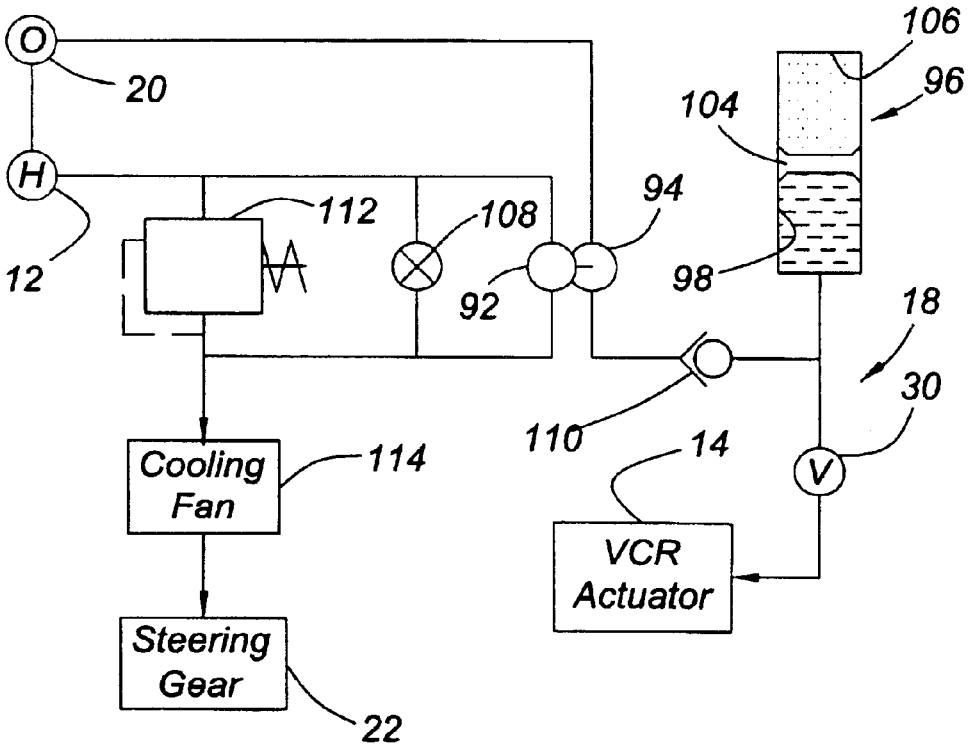
FIG. 7 illustrates a series hydraulically powered pump VCR control system according to the present invention.

FIG. 7 illustrates a series pumping system according to the present invention, in which lower pressure engine lubricating oil from engine oil pump 20 passes through control pump 94 and into a similar accumulator system including accumulator 96 having piston 104, which compresses gas within gas chamber 106 so as to provide muscle for discharging engine lubricating oil from liquid chamber 98 of accumulator 104, with the engine oil being discharged to VCR supply circuit 18 and through VCR supply valve 32 to VCR actuator 14. Unlike the embodiment of FIG. 6, with the system of FIG. 7 the high pressure hydraulic fluid from pump 12 first passes through hydraulic motor 92, with the flow being controlled by means of control valve 108. Having passed through hydraulic motor 92, the high pressure hydraulic fluid which has undergone partial energy depletion, passes through steering gear 22. This type of system as well as being package efficient, takes advantage of the fact that as noted above, that the peak demand placed upon engine driven accessory hydraulic pump 12 by the balance of the present VCR control system will seldom, if ever, coincide with the peak demands of other hydraulically powered devices in an automotive vehicle. As it is further noted above, this conclusion stems from the fact that highest power steering demand is encountered during parking or other low speed maneuvers, when the engine compression ratio would be operated at a fixed point.

One advantage of the embodiment of FIG 7 over the similar embodiment of FIG. 6 resides in the fact that steering gear 22 and hydraulic motor 92 can operate at different pressures. Accessory pump 12 will need to supply hydraulic oil under sufficient pressure to operate power steering gear 22 and pump motor 92.

With each of the embodiments illustrated in FIGS. 5–7, a tradeoff exists between hydraulic system flowrate and pressure requirements. Thus, if pistons 53 and 72 of FIG. 5 have different diameters, the engine oil pressure could be different from the hydraulic fluid pressure. The inventors have determined that with a typical system according to the present invention, piston 72 could have an area of 3 to 4 times that of piston 53. If this ratio is 4, and if the flow needed by VCR actuator 14 is only ¼ of the output of pump 12 at a pressure of 800 psi, then pump 12 will need to develop only 200 psi. This is advantageous because if pump 12 can generate 1300 psi, but only about 200 psi is required by VCR actuator 14, then 1100 psi, as controlled by valve 112, will be available to power steering gear 22. This is significant because experience has shown that most power steering gears rarely need more than 1100 psi for proper operation. FIG. 7 offers the additional advantage of a series hydraulic circuit including cooling fan 114, which is upstream from steering gear 22. Cooling fan 114 will include a bypass for allowing fan 114 to be shut down, as when the engine is cold.

Although the present invention has been described in connection with particular embodiments thereof, it is to be understood that various modifications, alterations and adaptations may be made by those skilled in the art without departing from the spirit and scope of the invention. It is intended that the invention be limited only by the appended claims.

What is claimed is:

1. A variable compression ratio control system for an internal combustion engine, comprising:

an engine driven accessory hydraulic pump;

a hydraulic accumulator system for receiving hydraulic fluid from said engine driven accessory pump and engine oil from an engine oil pump;

a variable compression ratio actuator; and a variable compression ratio supply circuit for furnishing high pressure engine lubricating oil from said hydraulic accumulator system to said variable compression ratio actuator.

2. A variable compression ratio control system for an internal combustion engine according to claim 1, wherein said engine driven accessory hydraulic pump comprises a power steering pump.

3. A variable compression ratio control system for an internal combustion engine according to claim 1, wherein said hydraulic accumulator system comprises:

a first chamber for receiving hydraulic fluid from said engine driven accessory hydraulic pump;

a second chamber for receiving engine lubricating oil from an engine lubricating oil circuit and for providing highly pressurized lubricating oil to the variable compression ratio supply circuit; and a third chamber interposed between said first and second chambers, with said third chamber comprising an elastically compressible medium for maintaining pressure within said second chamber as lubricating oil is withdrawn from the second chamber.

4. A variable compression ratio control system for an internal combustion engine according to claim 1, wherein said variable compression ratio actuator comprises a variable length connecting rod.

5. A variable compression ratio control system for an internal combustion engine according to claim 1, wherein said hydraulic accumulator system comprises a first gas-charged accumulator having a liquid chamber for receiving said hydraulic fluid from the engine driven accessory pump, and a gas chamber communicating with the gas chamber of a second gas-charged accumulator, with said second accumulator having a liquid chamber communicating with said variable compression ratio supply circuit.

6. A variable compression ratio control system for an internal combustion engine according to claim 1, wherein said hydraulic accumulator system comprises a primary accumulator having a first liquid chamber for receiving with said hydraulic fluid from the engine driven accessory pump, and a second liquid chamber communicating with a liquid chamber of a secondary gas-charged accumulator, as well as with said variable compression ratio supply circuit.

7. A variable compression ratio control system for an internal combustion engine according to claim 6, wherein the swept volumes of said primary and secondary accumulators are equivalent.

8. A variable compression ratio control system for an internal combustion engine according to claim 6, wherein the swept volumes of said primary accumulator is less than the swept volume of said secondary accumulator.

9. A variable compression ratio control system for an internal combustion engine according to claim 1, wherein said hydraulic accumulator system comprises:

a hydraulic motor driven by hydraulic fluid from the engine driven accessory pump;

a control pump coupled to and driven by said hydraulic motor, with said control pump being in fluid communication with oil flowing from a lubricating oil pump driven by the engine; and a gas-charged accumulator having a liquid chamber for receiving pressurized lubricating oil from said control pump, with said liquid chamber of said accumulator being in fluid communication with said variable compression ratio supply circuit.

10. A variable compression ratio control system for an internal combustion engine according to claim 1, wherein said hydraulic accumulator system comprises:

a hydraulic motor driven by hydraulic fluid from the engine driven accessory pump;

a control pump coupled to and driven by said hydraulic motor, with said pump being in fluid communication with oil flowing from a lubricating oil pump driven by the engine; and a gas-charged accumulator having a liquid chamber for receiving pressurized lubricating oil from said control pump, with said liquid chamber of said accumulator being in fluid communication with a variable compression ratio supply circuit and with a power steering system.

11. A variable compression ratio control system for an internal combustion engine, comprising:

an engine driven lubricating oil pump;

an engine driven accessory hydraulic pump;

a hydraulic motor driven by hydraulic fluid from the engine driven accessory pump;

a control pump coupled to and driven by said hydraulic motor, with said pump being in fluid communication with oil flowing from the lubricating oil pump;

a gas-charged accumulator having a liquid chamber for receiving pressurized lubricating oil from said control pump; and a variable compression ratio supply circuit in fluid communication with said liquid chamber of said accumulator, with said variable compression ratio supply circuit furnishing a high pressure lubricating oil control signal to a variable compression ratio actuator.

12. A variable compression ratio control system for an internal combustion engine according to claim 11, wherein said engine driven accessory hydraulic pump comprises a power steering pump.

13. A variable compression ratio control system for an internal combustion engine according to claim 12, further comprising a power steering gear driven by said power steering pump.

14. A variable compression ratio control system for an internal combustion engine according to claim 13, wherein said power steering gear and said control pump receive hydraulic fluid in series with each other.

15. A variable compression ratio control system for an internal combustion engine according to claim 13, wherein said power steering gear and said control pump receive hydraulic fluid in parallel with each other.

16. A variable compression ratio control system for an internal combustion engine according to claim 11, wherein said hydraulic motor comprises a gear motor.

17. A variable compression ratio control system for an internal combustion engine according to claim 11, wherein said control pump comprises a gear pump.

18. A variable compression ratio control system for an internal combustion engine according to claim 11, wherein said hydraulic motor comprises a reciprocating piston motor.

19. A variable compression ratio control system for an internal combustion engine according to claim 11, wherein said control pump comprises a piston pump.

20. A method for powering a variable compression ratio control system for an internal combustion engine, comprising the steps of:

providing a source of high pressure hydraulic fluid from an engine driven hydraulic pump;

providing a control pump driven by said high pressure hydraulic fluid;

charging a hydraulic accumulator with engine lubricating oil pressurized by said control pump; and feeding high pressure engine lubricating oil to a variable compression ratio actuator.

21. A method according to claim 20, further comprising the step of providing high pressure hydraulic fluid from the engine driven hydraulic pump to a power steering gear.

22. A method according to claim 20, further comprising the step of providing high pressure hydraulic fluid from the engine driven hydraulic pump to a power. brake system.

23. A method according to claim 20, further comprising the step of providing high pressure hydraulic fluid from the engine driven hydraulic pump to an engine cooling fan.

24. A method according to claim 20, further comprising the step of providing high pressure hydraulic fluid from the engine driven hydraulic pump to a series hydraulic circuit including an engine cooling fan upstream from a power steering gear.

* * * * *